US009022796B2

(12) United States Patent
Henzler

(10) Patent No.: US 9,022,796 B2
(45) Date of Patent: May 5, 2015

(54) ASSEMBLY OF PLUG CONNECTOR AND CIRCUIT BOARD

(75) Inventor: Magnus Henzler, Grossbettlingen (DE)

(73) Assignee: ERNI Production GmbH & Co. KG, Adelberg (DE)

( * ) Notice: Subject to any disclaimer, the term of this patent is extended or adjusted under 35 U.S.C. 154(b) by 0 days.

(21) Appl. No.: 14/117,909

(22) PCT Filed: May 18, 2012

(86) PCT No.: PCT/DE2012/000510

§ 371 (c)(1),
(2), (4) Date: Nov. 15, 2013

(87) PCT Pub. No.: WO2012/155891

PCT Pub. Date: Nov. 22, 2012

(65) Prior Publication Data

US 2014/0113477 A1 Apr. 24, 2014

(30) Foreign Application Priority Data

May 17, 2011 (DE) ..... 10 2011 101 819
Mar. 3, 2012 (DE) ..... 20 2012 002 352 U

(51) Int. Cl.
*H01R 12/00* (2006.01)
*H01R 12/72* (2011.01)
(Continued)

(52) U.S. Cl.
CPC ..... *H01R 12/72* (2013.01); *H01R 12/58* (2013.01); *H01R 12/7052* (2013.01); *H01R 12/724* (2013.01)

(58) Field of Classification Search
CPC ..... H01R 13/6658; H01R 12/724; H01R 12/716; H01R 13/6466; H01R 12/72; H01R 12/721; H01R 23/7073; H01R 12/727; H01R 12/712; H01R 12/57; H01R 12/7005
See application file for complete search history.

(56) References Cited

U.S. PATENT DOCUMENTS 4,533,203 A * 8/1985 Feldman et al. ..... 439/64
4,820,173 A * 4/1989 Thom et al. ..... 439/79
(Continued)

FOREIGN PATENT DOCUMENTS

DE 88 11 877 U1 11/1988
DE 89 05 434 U1 8/1990
(Continued)

OTHER PUBLICATIONS

International Search Report of PCT/DE2012/000510 mailed Sep. 27, 2012.
(Continued)

*Primary Examiner* — Xuong Chung Trans
(74) *Attorney, Agent, or Firm* — Collard & Roe, P.C.

(57) ABSTRACT

The invention relates to an assembly of a plug connector and a circuit board (200; 500), the plug connector (100; 400; 800) being arranged on an edge of the circuit board (200; 500; 801), characterized by contact elements (110, 120; 410, 420, 430; 805) arranged in, below, and above the circuit board plane, wherein at least the contact elements (110, 120; 410, 420, 430; 805) arranged below and above the circuit board are bent on the side of the contact elements facing the circuit board (200; 500; 801) in such a way that the contact elements lead from both sides of the circuit board (200; 500; 801) into openings in the circuit board (200; 500; 801) adapted to the contact elements (110, 120; 410, 420, 430; 805) and can be soldered there.

13 Claims, 5 Drawing Sheets

(51) Int. Cl.
*H01R 12/58* (2011.01)
*H01R 12/70* (2011.01)

(56) References Cited

U.S. PATENT DOCUMENTS

| | | | | | |
|---|---|---|---|---|---|
| 4,836,791 | A | * | 6/1989 | Grabbe et al. | 439/79 |
| 4,909,743 | A | | 3/1990 | Johnson et al. | |
| 4,992,052 | A | * | 2/1991 | Verhoeven | 439/62 |
| 5,472,349 | A | * | 12/1995 | Dixon et al. | 439/79 |
| 5,731,958 | A | * | 3/1998 | Kozel | 361/743 |
| 2010/0099274 | A1 | | 4/2010 | Hsieh et al. | |

FOREIGN PATENT DOCUMENTS

| | | | |
|---|---|---|---|
| DE | 296 01 655 | U1 | 3/1996 |
| DE | 20 2009 008 182 | U1 | 4/2010 |
| EP | 0 410 427 | A1 | 1/1991 |
| JP | 9-097647 | A | 4/1997 |

OTHER PUBLICATIONS

"Double-Sided Right-Angle Pin Connector", IBM Technical Disclosure Bulletin, International Business Machines Corp. (Thornwood), US, vol. 31, No. 5, Oct. 1, 1988, pp. 73/74, XP000023405, ISSN: 0018-8689.

* cited by examiner

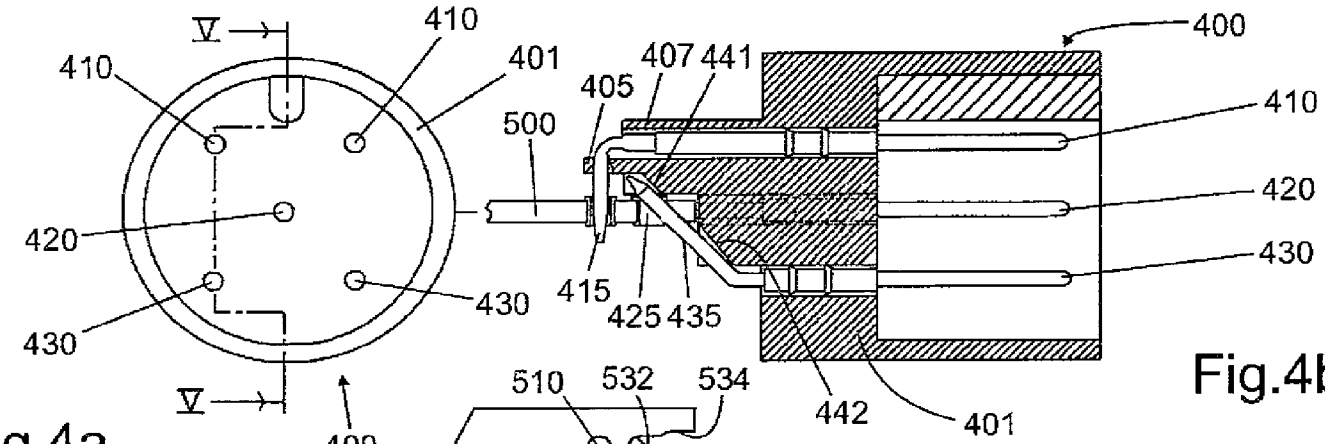
Fig.4b
Fig.4a
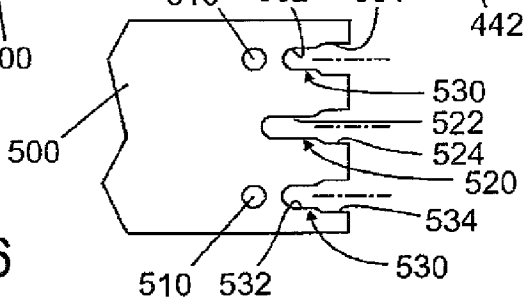
Fig.6
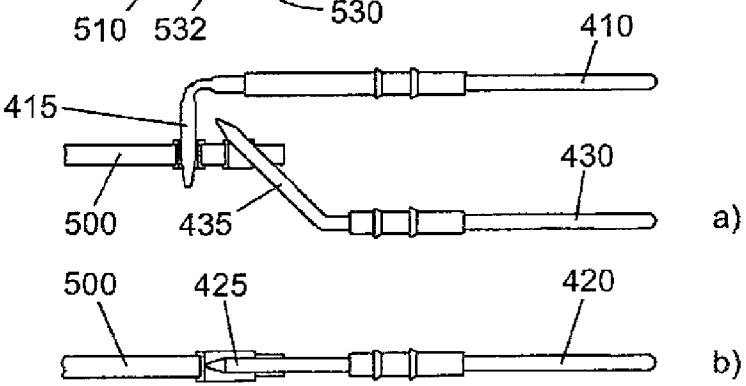
Fig.7

4020
4023
4022
500'
415
4040
401
4011
4010
400
4001
410
500
420
430

4022
4020
500"
415
4040
401
4012
4001
410
500
420
430

4023
4020
500'''
415
4040
401
4010
4013
4001
4010
410
500
420
420

ASSEMBLY OF PLUG CONNECTOR AND CIRCUIT BOARD

CROSS REFERENCE TO RELATED APPLICATIONS

This application is the National Stage of PCT/DE2012/000510 filed on May 18, 2012, which claims priority under 35 U.S.C. §119 of German Application No. 10 2011 101 819.4 filed on May 17, 2011 and under 35 U.S.C. §119 of German Application No. 20 2012 002 352.7 filed on Mar. 3, 2012, the disclosures of which are incorporated by reference. The international application under PCT article 21(2) was not published in English.

The invention relates to an assembly of a plug connector and a circuit board, with the plug connector being arranged on an edge of the circuit board.

DESCRIPTION OF THE PRIOR ART

Plug connectors that are arranged at an edge of a circuit board have long been known in the prior art.

For example, DE 296 01 655 U1 proposes a circuit board module with a plug connector where the circuit board consists of two multilayers pressed together with an intermediate insulating film with bilateral adhesive surfaces for galvanic isolation purposes and where a connection zone for the plug connectors is predrilled and plated-through accordingly. Plug connectors with shortened terminal pins are pressed into the multilayer circuit on both sides of the circuit board. In this way, the plug connector contacts are arranged symmetrically with respect to the central axis of the circuit board. The arrangement of a bipartite plug connector on both sides of a multilayer circuit board is complex and involves many manufacturing steps.

DE 88 11 877 U1 makes known a plug connector for a printed circuit module loaded on both sides with components, where one embodiment has the plug connectors developed as two shells and in another embodiment the contact pins of the plug connector are located on both sides of the printed circuit module.

The contact pins are embedded in the plastic housing of the plug connector.

DE 89 05 434 U1 discloses a circuit board connector for surface mounting, which is also arranged on an edge of a circuit board, with the plug-in contacts, i.e. the so-called "plug face", arranged symmetrically with respect to the central axis of the circuit board. Provision is made for each of the contact elements to be arranged above and below the plane of the circuit board and for additional contact elements to be arranged in an intermediate region at approximately the height of the front surface of the circuit board. The contact pins of the plug make contact by means of flexible conductor elements, which are connected at one end to the contact element and with their other end to the contact surfaces on the circuit board. The third contact elements have rigid solder tails as a means for connection, which are fastened to other contact surfaces on the upper side of the circuit board. The manufacturing costs and in particular the effort required to mount these circuit board plug connectors are not insubstantial.

EP 0 410 427 A1 discloses a plug connector for circuit boards, with a multilayer flexible conductor foil providing alternate levels for signal conductors and potential conductors to achieve a defined characteristic impedance, where the conductors on the individual layers are located in a fixed geometrical configuration with respect to each other in order to achieve each given characteristic impedance value. The connection is also achieved in this case with the aid of conduction foil.

DE 20 2009 008 182 U1 discloses an electrical connector that is inserted into apertures on a circuit board arranged accordingly for mounting purposes. These contacts are angled at right angles. The plug connector is mounted an the circuit board. Mounting on an edge is not possible without further work.

The aforegoing plug connectors cannot simply be mounted using an SMT (surface mount technology) process. In particular, mounting a plug connector arranged on an edge of a circuit board is not readily possible, as circuit boards loaded on both sides must first be loaded on one side and then on the other side, with the individual sides passing through automatic soldering processes. Generally, the SMT connections must be very accurately aligned on the soldering plane with components that can be mounted on the surface such as plug connectors to enable soldering without interruption of contact.

The object of the invention is to provide an assembly consisting of plug connectors and a circuit board, wherein the connector is arranged on an edge of the circuit board, which can be mounted in a simple manner, and also allows for surface mounting. The assembly consisting of connectors and circuit board is also to be designed such that the connector is affixed as stably as possible on the circuit board.

DISCLOSURE OF THE INVENTION

Advantages of the Invention

The object for an assembly consisting of a plug connector and a circuit board, with the plug connector positioned at an edge of the circuit board, is achieved by means of contact elements arranged in, below and above the plane of the circuit board, where at the least the contact elements above and below the plane of the circuit board on their side facing the circuit board are bent in such a way that they terminate in the openings in the circuit board that are adapted to fit the diagonally extending contact elements and can be soldered there. By virtue of the fact that the contact elements of the plug connector lie above, below and in the plane of the circuit board and interact with the openings adapted to fit them, it is possible to mount the plug connector easily, including surface mounting (fully automated loading process). In addition, such an assembly of the contact elements provides increased stability of the plug connector on the circuit board.

Advantageous developments and improvements of the devices specified in the independent claim are possible by means of the measures specified in the dependent claims.

Consequently, an advantageous design for the arrangement of the plug connector and circuit board can make provision for not only the contact elements above and below the circuit board to be bent, but also for the contact elements arranged in the circuit board to be bent, in particular bent once and extending obliquely. In this way, the density of contact elements can be increased.

Consequently, an advantageous embodiment makes provision for a plug connector insulator to have inclined surfaces for guiding and supporting the oblique contact elements. As a result, not only are the contact elements stabilized, particular during the soldering process, but the stability of the whole assembly consisting of connector and printed circuit board is increased.

Provision is also made advantageously for the housing to have lateral openings, with the boundary surface facing the circuit board extending in steps to accommodate different circuit board thicknesses that come to be positioned on the upper side of the circuit board. In this way the plug connector cannot follow its centre of gravity and flip over towards the underside of the circuit board during the fabrication process (loading and soldering). In addition, the plug connector is also fixed laterally through the interaction between the lateral openings and the circuit board. This arrangement allows one to dispense with additional holding devices during fabrication and the plug connector is located in a precisely replicable position (position and angle) that is necessary for further processing.

These steps correspond to the steps in the aforementioned boundary surfaces of the lateral opening of the plug connector housing facing the circuit board. In this way, a very stable two-point bearing is created for the plug connector on the circuit board.

Advantageous provision can also be made for the housing to be provided with shielding. Preferably, this shielding encompasses the outside of the housing and has resilient contact blades, which serve to mount and contact the plug connector.

In addition, advantageous provision is made for the side of the housing facing the printed circuit board to have a projection, with its boundary surface facing the circuit board extending in steps, each of which come to rest on the upper side of a circuit board.

Highly preferable provision is made for the steps arranged in the projection to correspond with the steps arranged in the boundary surface of the opening in such a way that they each rest on a pair of matching steps on the upper side of the circuit board in the assembled state of the plug connector. In this case, a two point bearing of the plug connector housing on the upper side of the circuit board can be achieved, thus significantly reducing any tendency for the plug connector housing to roll over, not only during the manufacturing process, i.e. during the soldering process, but also in the finished soldered state, thus effectively counteracting damage to the soldered connection by means of leveraging during its production and subsequent plugging in.

The steps are developed advantageously in a way that allows the plug connector to be positioned off centre or centred in relation to the circuit board subject to the design.

The openings, which are adapted to the inclined contact elements, can in principle be designed in any way. An advantageous embodiment provides for these openings to be elongated openings. Provision is preferably made for these elongated openings to be only partially plated through, in particular at their ends. Provision can also be made for the elongated openings to have plated through holes at their ends, which are inserted into the circuit board perpendicular to the plane of the circuit board. Such a design can be manufactured particularly simply. The plug connector itself can be designed in any manner. In particular, the plug connector can have a plurality of contact elements on a plurality of overlapping planes. Provision is made in one advantageous embodiment of the arrangement consisting of both connectors and circuit board for the contact elements located on the plane of the circuit board, which are not to be bent and to be developed such that they can be soldered in the elongated openings.

Prior to soldering, a soldering paste is applied into these through-plated areas at the end of the elongated opening using screen printing from known assembly processes. In particular, the oblique nature of the contact elements arranged under the circuit board prevents the soldering paste from being "dragged along" during dipping of the contact element. In this way, only the tip of the contact elements that is to be soldered is dipped into the paste. This results in a replicable soldering point with a constant soldering paste volume.

The plug connection itself can assume any form, for example round, polygonal, oval, trapeze-shaped or rectangular.

BRIEF DESCRIPTION OF THE DRAWINGS

Embodiments of the invention are shown in the drawings and are described in more detail below.

In the drawing

FIG. 4*a* shows a further embodiment of an assembly according to the invention consisting of plug connectors and circuit board;

FIG. 4*b* shows a cutaway view of the assembly illustrated in FIG. 4*a* along the line V-V;

FIG. 6 shows a schematic section of a circuit board for fastening a plug connector illustrated in FIG. 4 and FIG. 5.

FIG. 7*a, b* shows the arrangement of the contact elements on and outside the plane of the circuit board;

DESCRIPTION OF THE EMBODIMENTS

Figure 2:
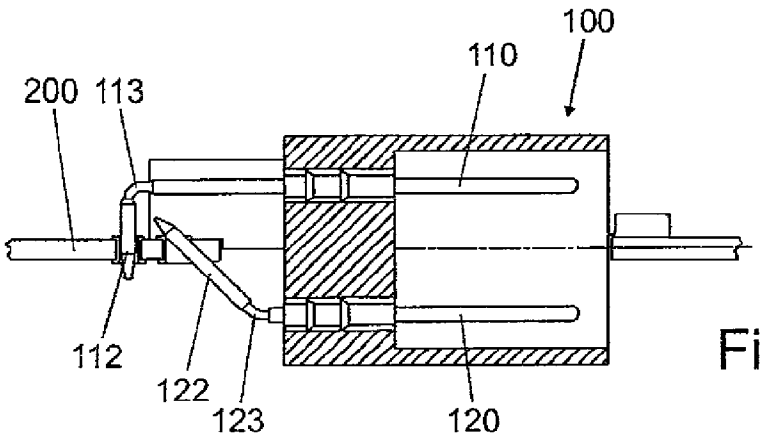
FIG. 2 shows a cutaway view of the plug connector illustrated in FIG. 1 along the line II-II.
Figure 3:
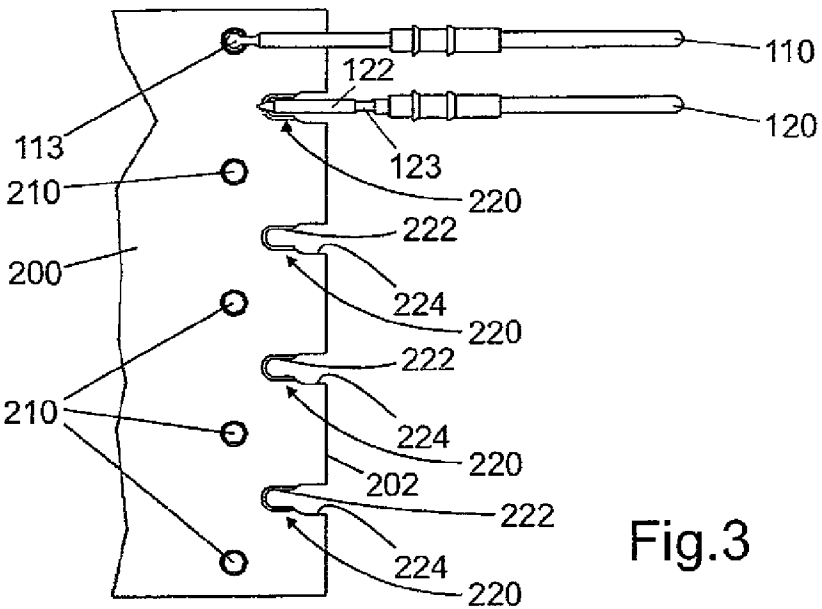
FIG. 3 schematically shows the arrangement of the contact elements in a circuit board.
Figure 1:
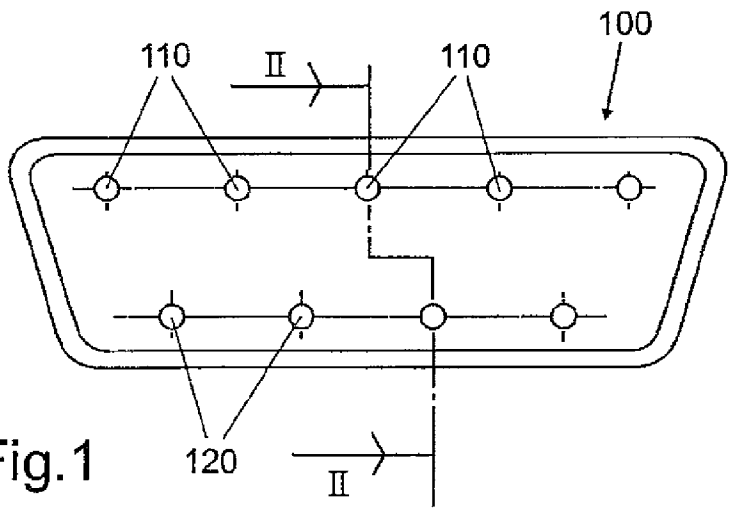
FIG. 1 shows a front view of an embodiment of an assembly consisting of plugs and plug connectors according to the invention.

One assembly consisting of plug connector and circuit board shown in FIG. 1 to FIG. 3 comprises a plug connector 100, which can for instance have the shape of a so-called D-Sub plug connector, with an essentially trapezoidal metallic housing in which contact elements 110, 120 are arranged on two planes, one above and one below a circuit board 200. The circuit board 200 itself has openings 210, 220 adjacent to an edge 202 onto which the plug connector 100 is arranged, with the openings 210 being through-plated boreholes, while the openings 220 are elongated openings that are only contacted at their ends 222. The contact elements 110 arranged on the upper plane are essentially bent at right angles, the end of the contact element 112 being inserted into the openings 210.

The contact elements 120 arranged on the lower plane are also bent, with the angle being about 135°, so that the ends of the contact elements 122 enter the circuit board 200 at an angle of about 45°. For this purpose, the elongated openings 220 have a frontal area 224 facing the edge 202 that is wider than at their end 222, where the diameter of the openings, that can for example be developed as plated through boreholes, corresponds essentially to the width of the end 122 of the contact element.

The contact elements can be provided with tapers 113, 123 so that they can be bent easily at the defined points.

A distinctive feature of the assembly consisting of circuit board 200 and plug connector 100 is that the contact elements 110, 120 of the plug connector 100 are arranged on both sides of circuit board, i.e. not only above, but also below the circuit board. This makes it possible in a particularly advantageous manner to arrange the plug connector on the edge. The ends of the contact elements bent at different angles which makes it possible to adapt to the corresponding contact elements 210, 220 of the circuit board 200 optimally, also making the automated loading process and the use of different widths of circuit boards possible.

FIGS. 4 to 7 show further embodiments of an assembly consisting of plug connector 400 and circuit board 500 according to the invention, with FIG. 7 divided into two separate drawings FIG. 7*a*, FIG. 7*b*. FIG. 7*a* shows the arrangement of the contact elements outside the plane of the circuit board, that is above and below the plane of the circuit board and FIG. 7*b* shows the arrangement of the contact elements on the plane of the circuit board. The division has only been selected to provide a better overview. In this case the plug connector 400 is round in shape, with the housing 401 made of plastic. Contact elements are arranged on the three planes in the plug connector 400 itself. A first plane above a circuit board 500 is provided with contact elements 410. A contact element 420 is arranged at the level of the circuit board 500 and further contact elements 430 are arranged below plane of the circuit board 500. The contact elements 410 arranged above the plane of the circuit board are bent at right angles to the circuit board 500 and have contact element ends 415. The contact elements 430 arranged below the planes of the circuit board are angled at approximately 135° with respect to the circuit board 500 and have contact element ends 435. The central contact element 420 extends linearly without bending and has a contact element 425. This central contact element 420 extends into an opening 520 in the circuit board 500 in the form of an elongated hole with an entry opening 524 with a larger cross-section than the contact area 522. Similarly, the openings 530 for the 135° angled contact element ends 435 are also developed as elongated hole-like openings with an entry area 534 that has a larger cross-section then the contact area 532 accordingly. The openings 510 for the contact elements bent at right angles are for example plated-through boreholes.

Inclined surfaces 441, 442 are arranged in the housing 401 of the plug connector 400, these surfaces guiding and supporting the contact element ends 435 that extend obliquely. Similarly, the bent, right-angled contact elements 410 can also run along in corresponding housing sections 407, 405 (FIG. 4*b*).

Figures 5, 5A, 5B:
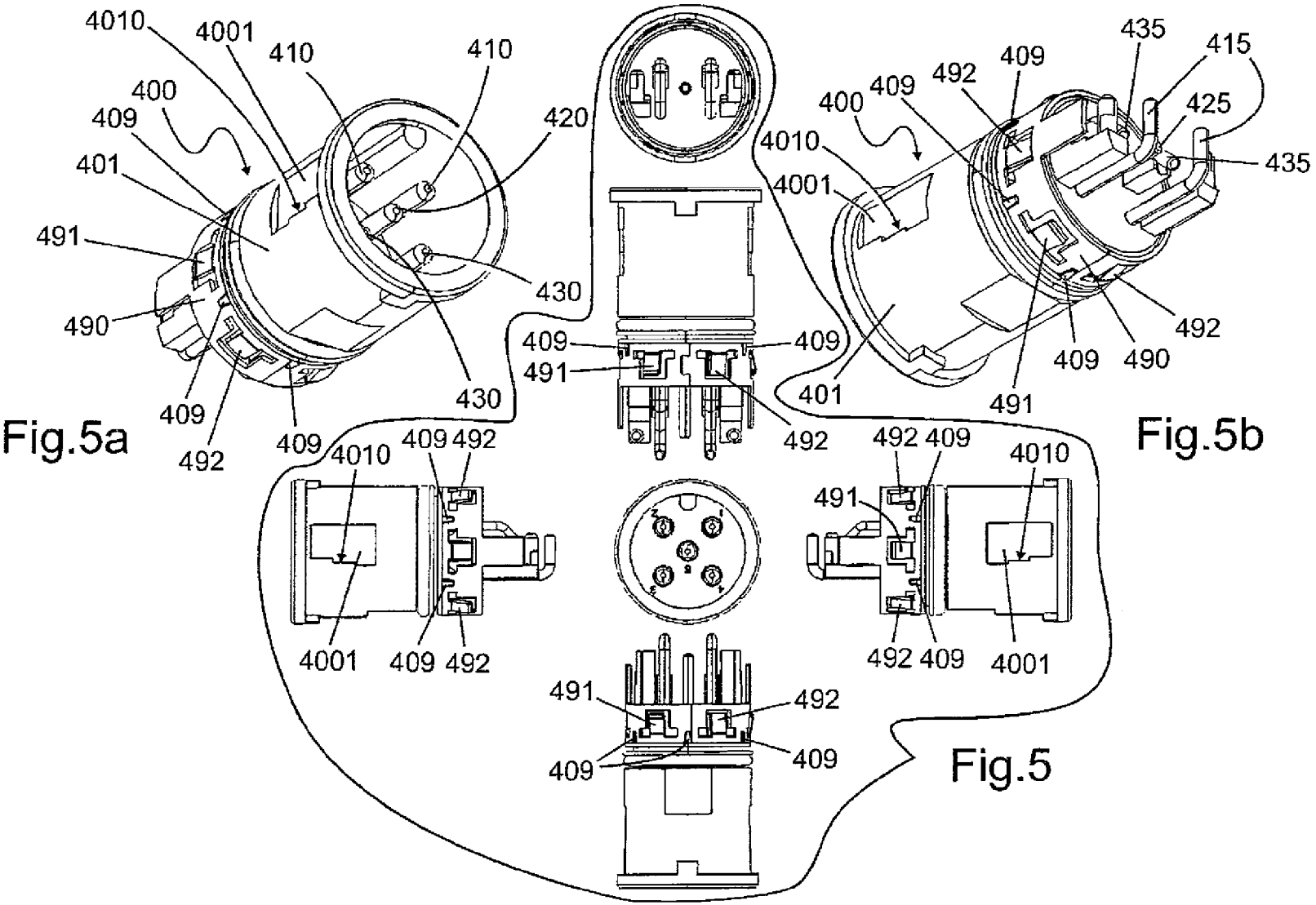
FIG. 5 shows different views of an embodiment of a plug connector according to the invention
FIG. 5*a* shows an oblique isometric frontal view of a further embodiment of a plug connector according to the invention with shielding.
FIG. 5*b* shows an oblique isometric rear view of the plug connector illustrated in FIG. 5*a;*

FIGS. 5*a* and 5*b* show isometric views of a plug connector, with the same elements as those in FIGS. 4*a* and 4*b* having the same reference symbols as in those drawings. In contrast to the plug connectors illustrated schematically in FIG. 4*a* and FIG. 4*b*, the plug connector shown in FIGS. 5*a* and 5*b* is provided on its outer perimeter and in the rear area facing the circuit board 500 with shielding 490, that encompasses the housing 401 of the plug connector in an annular fashion and encompasses resilient contact blades 491 bent outwards, which for example are used in a metal housing to create an electrically conductive connection (not shown), as well as the blades 492 bent inwards that latch into the plug connector housing such that the shielding can be fastened to the housing 401 in this way.

Furthermore, the shielding is provided with at least one wedge-shaped rebate, into which a corresponding rib 409 of the plug connector engages. This prevents the pipe from rotating if torque is conducted into the plug housing via the inserted cable plug.

Figures 5C, 5D, 5E:
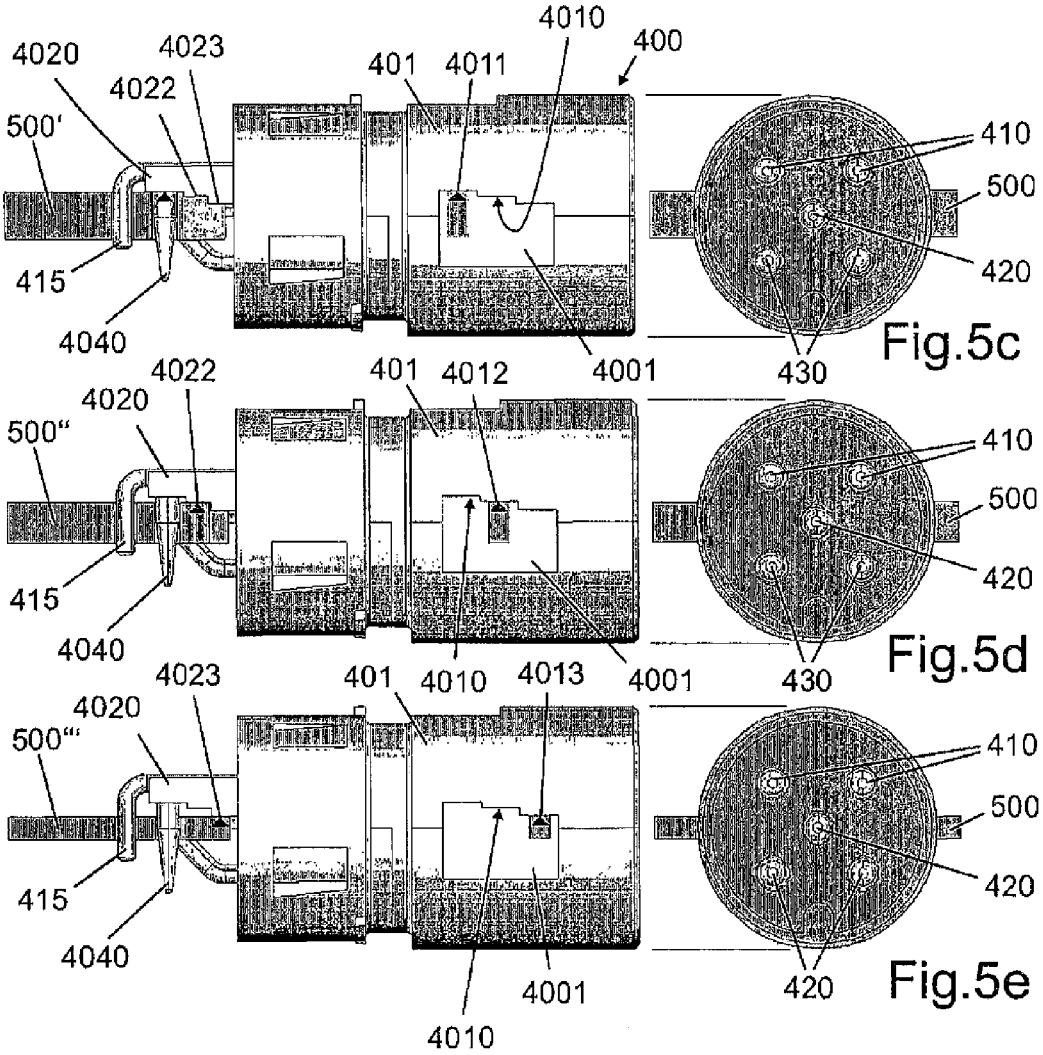
FIGS. 5*c*-5*e* show side views of a plug connector assembly according to the invention on circuit boards of differing thicknesses.

The arrangement of the contact elements on both sides of the circuit boards 200, 500 and therefore the arrangement of the central axis of the plug connector on the same plane as the central axis of the circuit board, results in an even distribution of the forces generated during for example the plugging in the process. The distribution of forces is considerably better than for a plug connector that is only arranged on one side of the circuit board. As that type of plug connector is arranged on one side of a circuit board outside the plane of the circuit board, a certain plug connector "top heaviness" occurs as its centre of gravity lies outside the circuit board. To counteract this top heaviness, provision is made for openings 4001 in the housing 400 of the plug connector according to the invention, with its one boundary surface 4010 facing the circuit board 500 having steps 4011, 4012, 4013 for adapting to different circuit board thicknesses. This is shown schematically in FIGS. 5*c* to 5*e*, where the arrangement of the plug connector is shown schematically on circuit boards of differing thicknesses 500', 500" and 500'". The boundary surface 4010 is provided with three steps 4011, 4012, 4013 in this embodiment, with the step 4011 lying on a circuit board 500' with a thickness of for example 2.0 measurement units, whereas the stepped surface 4012 lies on a circuit board 500" with a thickness of 1.6 measurement units and the stepped surface 4013 lies on a circuit board 500'" with a thickness of 1.0 measurement units. In order to make provision for a particularly good bearing for the plug connector housing 400 on the circuit boards 500', 500", 500'", provision is made additionally for a housing projection 4020 at the rear end of the housing 400 respectively facing the circuit board, with this projection also having a stepped boundary surface facing the circuit board 500', 500", 500'". The first step 4021 forms a bearing surface that lies on the circuit board 500' with a thickness of 2.0 measurement units. This step corresponds to the step 4011 of the collateral opening 4001 of the plug housing. Similarly, the bearing surface formed by the step 4022 corresponds with the bearing surface 4012 of the opening 4001 and the bearing surface formed by the step 4023 corresponds with the bearing surface 4013 of the opening 4001. In this manner, provision can be made for one and the same plug connector for mounting on circuit boards of differing thicknesses, with it located on the circuit boards with no risk of turning over due to these bearing surfaces, which means that the fabrication process (loading and soldering) is simplified immensely as one can dispense with additional holding devices during the fabrication process accordingly.

Figure 8:
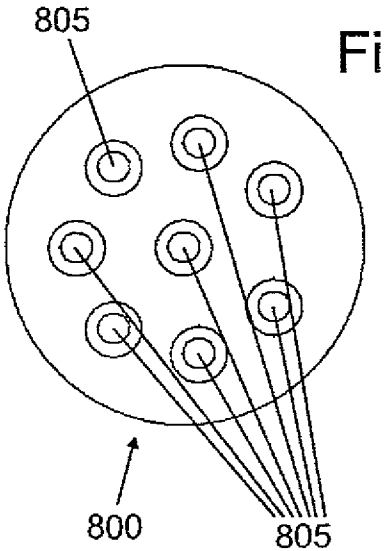
FIG. 8 shows a further embodiment of just a plug connector on a circuit board according to the invention.
Figure 9:
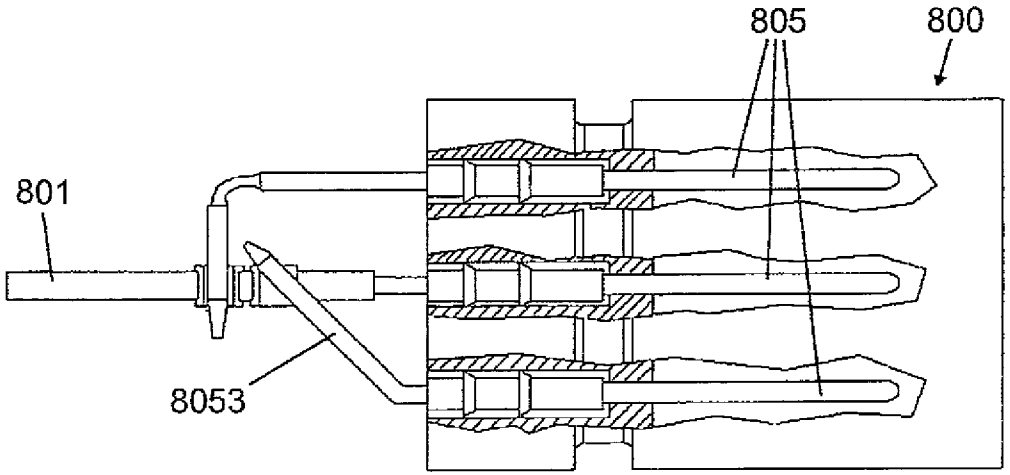
FIG. 9 shows a cross-section of the assembly illustrated in FIG. 8.
Figure 10:
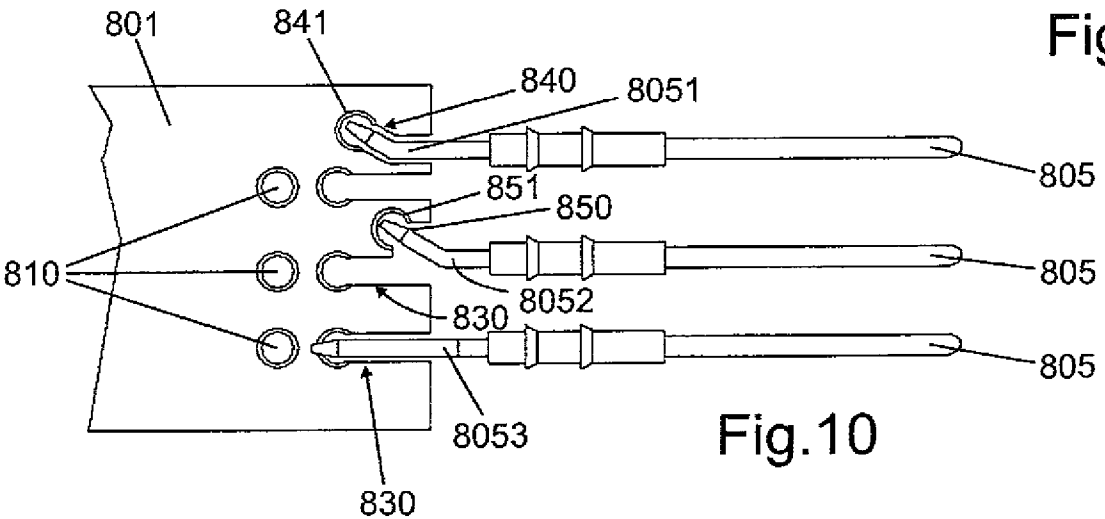
FIG. 10 schematically shows the arrangement of the contact elements in a circuit board.

FIG. 8 schematically shows another embodiment of an assembly according to the invention, where the plug connector 800 has a plurality of levels of contacts 805 located above and adjacent to each other. Through-plated openings 810 are arranged in a circuit board 801 for these contact elements, as are elongated openings 830 for linearly extending contact elements that are terminated by through-plated boreholes at their ends, as well as elongated openings 840, 850 that are also terminated at their ends for example by through-plated boreholes 841, 851. However, in contrast to the embodiments described above, some of the contact elements on the plane of the circuit board are also bent, i.e. not bent towards the plane of the circuit board below and above the plane of the circuit board, but bent in the plane of the circuit board itself, such as shown for example by the bends 8051 and 8052 of the contact elements 805 lying on the plane of the circuit board. Provision can also be made for the contact elements to be bent at the same time not only on the plane of the circuit board, but also perpendicular to the plane of the circuit board, such as for example the bend 8053 of the contact elements 805. In any case the bends are developed to ensure that the contact elements are arranged as optimally as possible on the circuit board, even for circuit boards of different thicknesses.

A particular advantage of such plug connectors is that they can be mounted on circuit boards of differing thicknesses. The plugs are not bound to a fixed circuit board thickness.

In a certain sense, the plug connector is "insensitive" to tolerances involving the thickness of the circuit board as a result of the bent contact elements on both sides of the circuit board. Furthermore, it can be adapted to different circuit board thicknesses easily. A further advantage is that such a plug connector can be made in a simple manner, particularly as the bent contact elements can be produced in a simple manner.

The invention claimed is:

1. An assembly of a plug connector and circuit board (200, 500; 801), wherein the plug connector (100; 400; 800) is arranged on an edge of the circuit board (200; 500; 801), comprising contact elements (110, 120; 410, 420, 430; 805) arranged in, below, and above the circuit board plane, wherein at least the contact elements (110, 120; 410, 420, 430; 805) arranged below and above the circuit board are bent on the side of said contact elements facing the circuit board (200; 500; 801) in such a way that said contact elements lead from both sides of the circuit board (200; 500; 801) into openings in the circuit board (200; 500; 801) adapted to the contact elements (110, 120; 410, 420, 430; 805) and can be soldered there, wherein a housing (400) of the plug connector, which housing is formed especially by an insulating body and accommodates the contact elements (110, 120; 410, 420, 430, 805), comprises obliquely extending areas (441, 442) for guiding and supporting obliquely extending contact elements, wherein the housing (400) comprises a projection (4020) on its side facing the circuit board (500', 500", 500'"), with the boundary surface of said projection which faces the circuit board extending in steps (4021, 4022, 4023) which respectively come to lie on an upper side of the circuit board.

2. An assembly according to claim 1, wherein the contact elements (805) situated in the circuit board plane are bent, especially bent once, and extend in an inclined fashion.

3. An assembly according to claim 1, wherein the housing comprises lateral openings (4001), whose one boundary surface (4010) facing the circuit board (500, 500', 500", 500'") extends in steps (4011, 4012, 4013) for adaptation to different circuit board thicknesses, which steps respectively come to lie on an upper side of the circuit board.

4. An assembly according to claim 3, wherein the steps (4021, 4022, 4023) arranged in the projection (4020) correspond to the steps (4011, 4012, 4013) arranged in the boundary surface (4010) of the opening (4001) in such a way that in the mounted state of the plug connector one respective pair of associated steps rest on the upper side of the circuit board.

5. An assembly according to claim 1, wherein the steps (4011, 4012, 4013, 4021, 4022, 4023) are set up to enable an off-center or precisely central positioning of the plug connector (400) in relation to the circuit board (500, 500', 500", 500'").

6. An assembly according to claim 1, wherein the housing has a shielding (490).

7. An assembly according to claim 6, wherein the shielding encloses the housing on its outside and comprises resilient contact tongues (491) which are used for fastening and making contact with the plug connector.

8. An assembly according to claim 1, wherein the openings in the circuit board (200; 500; 801) adapted to the contact elements (110, 120; 410, 420, 430; 805) are elongated openings (220; 520, 530; 830; 840).

9. An assembly according to claim 8, wherein the elongated openings (220; 520, 530; 830; 840) are only partly provided with through-hole plating, especially at their end.

10. An assembly according to claim 8, wherein the elongated openings (220; 520, 530; 830; 840) comprise boreholes with through-hole plating at their end.

11. An assembly according to claim 8, wherein the contact elements (420) situated in the circuit board plane are not bent and are set up so that they can be soldered in the elongated openings (520).

12. An assembly according to claim 1, wherein the plug connector (100; 400; 800) comprises several contact elements (110; 120; 410, 420, 430; 805) disposed on top of one another in several levels.

13. An assembly according to claim 1, wherein the plug connector (100; 400; 800) has a round, polygonal, oval, trapezoidal or rectangular shape.

* * * * *